US005685392A

United States Patent [19]

Phillips et al.

[11] Patent Number: 5,685,392

[45] Date of Patent: Nov. 11, 1997

[54] MULTIPLE LIFT PLATFORM WITH LATERAL MOVEMENT

[75] Inventors: Garry Phillips, Ponte Vedra; Dan Lee, Jacksonville; Herbert Worm; Chris Phillips, both of Ponte Vedra Beach; Lewis Hardwick, Jacksonville; Charles Altendorf, Jacksonville; Fabian Tew, Jacksonville, all of Fla.

[73] Assignee: Vertex Systems Group, Inc., Jacksonville, Fla.

[21] Appl. No.: 333,837

[22] Filed: Nov. 3, 1994

(Under 37 CFR 1.47)

[51] Int. Cl.[6] ..... E04G 1/00

[52] U.S. Cl. ..... 182/131; 182/223; 182/19; 182/141

[58] Field of Search ..... 182/141, 150, 182/142, 148, 36, 37, 130, 131, 19, 223

[56] References Cited

U.S. PATENT DOCUMENTS

| | | | |
|---|---|---|---|
| 3,305,113 | 2/1967 | Gardner | 182/150 |
| 5,392,878 | 2/1995 | Bennett | 182/131 |
| 5,423,396 | 6/1995 | Fahrion | 182/36 |
| 5,549,176 | 8/1996 | Hawkins | 182/63 |

FOREIGN PATENT DOCUMENTS

| | | | |
|---|---|---|---|
| 387673 | 10/1971 | U.S.S.R. | 182/131 |

*Primary Examiner*—Alvin C. Chin-Shue
*Attorney, Agent, or Firm*—Thomas C. Saitta

[57] ABSTRACT

A powered lift platform apparatus is disclosed having a fixed support structure and two independently operable platforms which move in both the vertical and horizontal direction, for use with transport containers, such as trailers, shipping containers or rail cars. Each platform comprises an extended work surface or walkway and two moveable end platforms which extend perpendicularly to the extended work surface. Each platform may be independently raised and lowered, and each may be moved laterally toward the opposite platform. The distance between the two platforms and the length of the end platforms, coupled with the range of lateral movement of each platform, are such that the free ends of opposing end platforms can be juxtapositioned to create a rectangular pathway for workers to completely circle the transport container.

17 Claims, 4 Drawing Sheets

MULTIPLE LIFT PLATFORM WITH LATERAL MOVEMENT

BACKGROUND OF THE INVENTION

This invention relates generally to elevating lift platforms capable of both vertical and lateral movement of the platform. More particularly, the invention relates to such lift platforms having two opposed, independently operable platforms adapted to encircle a work object. Even more particularly, the invention relates to such platforms used to support workers involved in construction or repair of generally rectangular or cylindrical transport containers such as over-the-road trailers, containers or rail cars, where such platforms have automatic positioning means to precisely locate the platform relative to the transport container and safety means to prevent movement of the platform should objects be in a position to impede the travel of the platform either vertically or laterally.

In situations where it is necessary for workers to be positioned at heights above the floor it is typical to employ either fixed scaffolding or ladders, rolling scaffolding, rolling ladders or individual powered lift platforms. As the extension height increases, these devices tend to become unstable and dangerous. Furthermore, to reposition these devices the worker must descend to the ground, release any security mechanism, move the device, secure the device and then ascend. Injury risks are high due to the instability of the devices, the need to manually reposition the devices and the need for the worker to climb to reach the work platform. These devices are not well suited for jobs which require work extending over a long distance, circumstances which are likely to be encountered in the repair of transport containers. Because of their limited size and the need to climb in most instances, toolboxes or large numbers of tools cannot be kept at hand on the work platform, again requiring the worker to make numerous descents and ascents to obtain tools or materials during the course of a job.

While powered elevating lift platforms are known in general, none are particularly well suited for use in the repair of large transport containers, trailers or rail cars. It is an object of this invention to provide a powered lift platform which is especially suited for use with these types of transport containers, whereby the lift platform provides worker access to the entire length and breadth of the transport container such that workers can repair any location on either side or either end of the transport container. It is a further object to provide such a lift platform which is comprised of two symmetrical, independently operable platforms whereby workers on one side or end of the transport container can be positioned at a different height from workers on the opposite side or end. Another object is to provide such a lift platform where the platforms move laterally as well as vertically to provide optimum accessibility to the transport container. Still another object is to provide automatic positioning means to laterally position the platform with means to stop movement of the platform to prevent damage to the transport container. Still another object is to provide safety means whereby movement of the platform is halted if any object is in a position to impede either the vertical or lateral movement of the platform.

SUMMARY OF THE INVENTION

The invention comprises in general a powered lift platform apparatus having a fixed support structure and two independently operable platforms which move in both the vertical and horizontal direction, for use with transport containers, such as trailers, shipping containers or rail cars. Each platform comprises an extended work surface or walkway and two moveable end platforms which extend perpendicularly to the extended work surface. Each platform may be independently raised and lowered, and each may be moved laterally toward the opposite platform. The fixed support structure is of sufficient height to allow the platforms to be raised above the height of the transport container, to allow the transport container to be positioned centrally between the two platforms. The distance between the two platforms and the length of the end platforms, coupled with the range of lateral movement of each platform, are such that the free ends of opposing end platforms can be juxtapositioned to create a rectangular pathway for workers to completely circle the transport container.

Lateral movement of each platform allows the work surface to be positioned within inches of the sides of the transport container being repaired. Longitudinal movement of the end platforms allow them to also be positioned within inches of the ends of the transport container. Automatic positioning means, comprising for example infrared beams located at appropriate sites, allow the operator to laterally move the platform to the optimum proximity relative to the transport container while providing for automatic movement stoppage to prevent damage to the transport container. Vertical movement is restricted unless the platform is in the fully retracted lateral position. Automatic safety means, again for example infrared beams, prevent movement of the platform in either the vertical or lateral direction if a foreign object is in a position to impede movement in either direction.

The invention further comprises operator control stations on the ground and separately on each platform, with preferably multiple operator stations on each platform. Safety gates, which must be in proper position and secured to allow platform movement, are positioned on the longitudinal ends of the platform and on the free ends of each end platform. An outer safety railing extends the length of the platform. Preferably, a traveling tool station is mounted onto each platform, the tool station being adapted to move the entire length of the platform to provide storage and easy access to a large number of tools without the necessity of the worker returning to the ground. Lift winches can be mounted along the central axis of the support structure. Each platform can be constructed to operate as a single unit, or alternatively individual segments of a single platform, with related safety gates, controls, etc., can be operated independently to allow different workers to be positioned at different heights on the same side of the transport container.

DETAILED DESCRIPTION OF THE INVENTION

Figure 1:
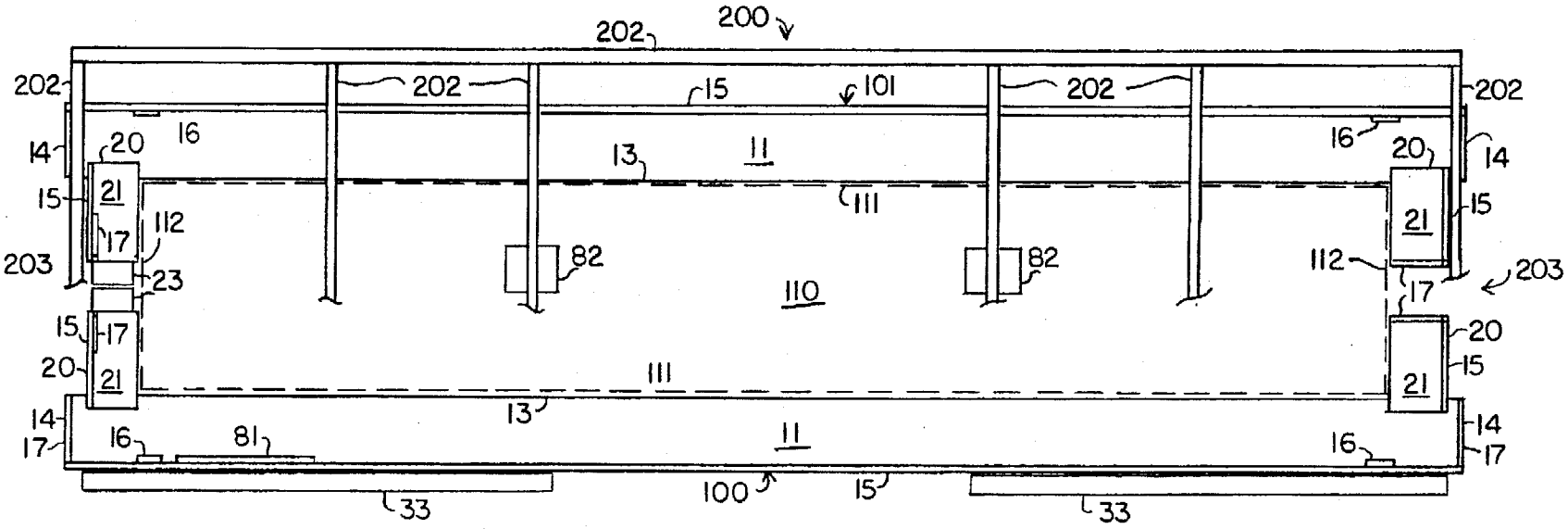
FIG. 1 is a vertical view of the invention with some elements exposed for clarity.
Figure 2:
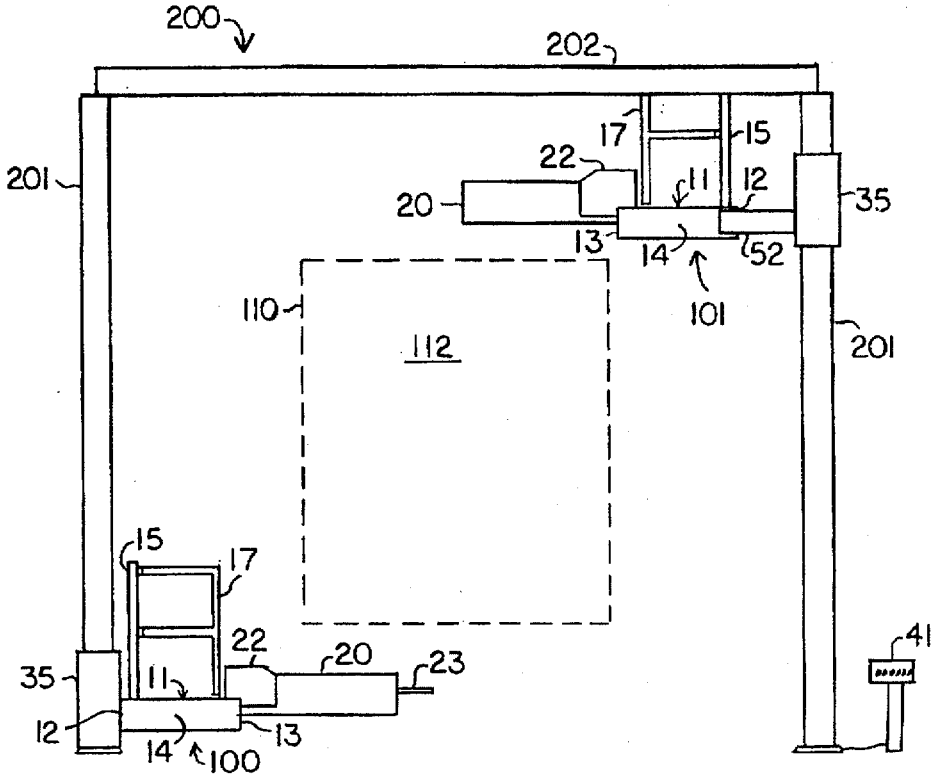
FIG. 2 is an end view of the invention showing one platform in the raised position and the other platform in the lowered position.

Referring now to the drawings, the invention will now be described in detail with regard to the best mode and preferred embodiment. In general, as shown in FIGS. 1 and 2, the invention comprises an external support structure 200, a first platform 100 and a second platform 101, vertical movement means 30, and lateral movement means 50. Preferably, the invention further comprises four end platforms 20, automatic positioning means 60 and automatic safety means 70.

The support structure 200 is comprised of vertical members 201 and horizontal members 202 joined to create a generally rectangular framework with at least one and preferably two unobstructed open ends 203. Support structure 200 must be able to support many tens of thousands of pounds, and is preferably constructed of steel I-beams or the like. The minimum height, width and length of support structure 200 may vary and is dependent on the particular transport container 110 being worked on, and also must be sufficient to allow entry and exit of the transport container 110 through an open end 203. The support structure should be tall enough to allow both platforms 100 and 101 to be raised above the maximum height of the transport container 110 for ease of entry and exit. For example, a typical trailer is approximately 45 feet long, 8 and a half feet wide and 13 and a half feet tall. The support structure 200 for this application should be about 63 feet long, 20 feet wide and 18 feet in height to allow sufficient room around the transport container 110 for the platforms 100 and 101, the movement means 30 and 50, the end platforms 20 and other components. A typical rail car is 70 feet long, 9 feet wide and 15 feet tall, so the corresponding support structure 200 for this application would need to be even larger. Preferably, horizontal members 202 are also strong enough to support one or more powered winches 82 for lifting machinery or components of the transport container 110 itself.

Platforms 100 and 101 are preferably substantially identical, although it is understood that there can be a number of differences between the two which will still be encompassed by the invention. Platform 100 is mounted onto one longitudinal side of the support structure 200 and platform 101 is mounted onto the opposite longitudinal side of support structure 200. Each platform 100 and platform 101 operates independently from the other. In general each platform 100 and 101 comprises an elongated horizontal work surface or walkway 11 approximately 3 feet across which is capable of supporting workers and equipment between a longitudinal interior edge 13 and a longitudinal exterior edge 12. Interior edge 13 faces the interior of the invention and is preferably linear to allow relatively close abutment with the side 111 of the transport container 110. Exterior edge 12 faces outward and has a safety rail 15 mounted along its entire length to prevent workers from falling off work surface 11. Safety gates 17 are preferably mounted on each end 14 of the work surface 11 to allow access to the work surface 11 when it is at ground level. Preferably the safety gates 17 encompass means to preclude any movement of the platform 100 or 101 unless the gates 17 are closed and secured.

End platforms 20 are mounted on the interior side near each end 14 of the work surface 11. End platforms 20 each have a platform work surface 21 extending perpendicularly from work surface 11 and are longitudinally positionable along the length of platform 100 or 101. Longitudinal positioning means 22 of any type commonly known in the art, such as rollers or the like, allow the end platforms 20 to be abutted adjacent the ends 112 of the transport container 110 no matter what the particular length of the transport container 110. The platform work surface 21 extends sufficient distance laterally such that when an end platform 20 of platform 100 is positioned opposite the end platform 20 of platform 101, a worker can traverse from platform 100 to 101 because of the nearness of the two platform work surfaces 21. If the lateral separation between opposite end platforms 20 is too great because of the width of the transport container, extension members 23 connected to each end platform 20 are provided to increase the lateral length a few extra feet. For example, in the application for repairing a trailer, the end platforms are preferably about 4 feet in length, with an extension member 23 adding about 2 extra feet to each. Thus the lateral pathway created by the combination of two end platforms 20 can range from 8 to 12 feet in length. It is preferable that each end platform 20 also have a safety gate 17 which precludes platform movement if not closed and secured. The combination of the four end platforms 20 with the two work surfaces 11 results in a continuous rectangular walkway completely encircling the transport container 110 when platforms 100 and 101 are positioned at the same height.

Figure 7:
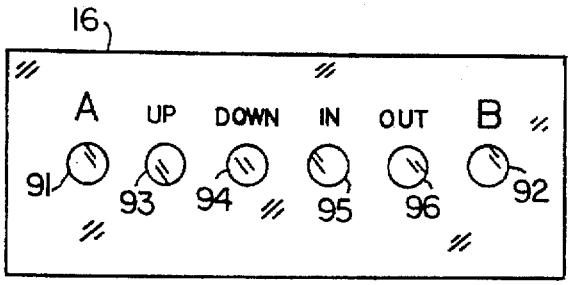
FIG. 7 is a front view of an operator control device.

Each platform 100 and 101 is capable of independent movement in both the vertical and horizontal direction. Operator control stations 16, at least one mounted on each platform 100 and 101, and also preferably at least one ground operator control station 41, control the movement of the platforms 100 and 101. Preferably each operator control station 16 and each ground control station 41 can operate both platforms 100 and 101, with a typical control configuration shown in FIG. 7. Platform 100 has a control 91 and platform 101 has a separate control 92 which must be activated to allow movement of either platform. With either control 91 or control 92 activated, controls 93, 94, 95 or 96 can be activated to move the particular platform either up, down, in or out, respectively. A given operator control station 16 can only move one platform at a time.

Figure 3:
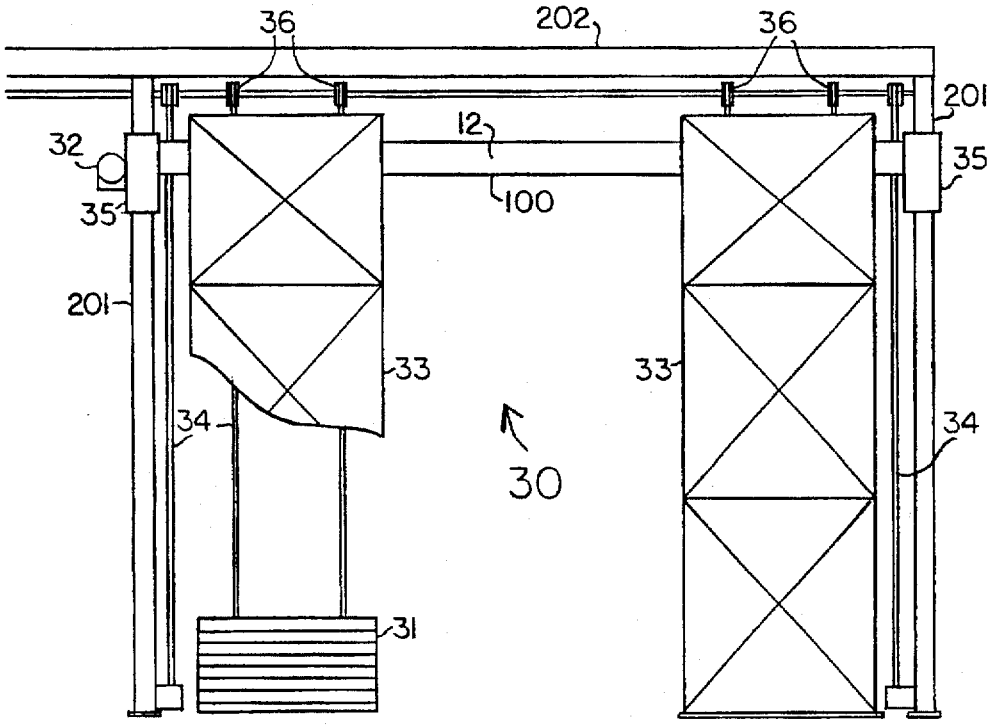
FIG. 3 is a longitudinal exposed view of the platform vertical movement means.
Figure 4:
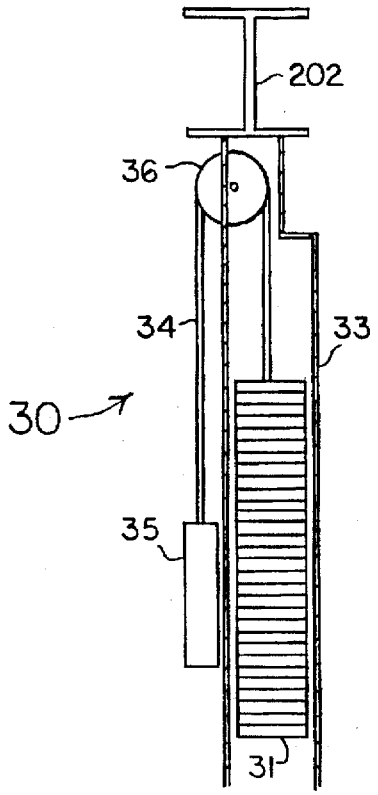
FIG. 4 is side view of the platform vertical movement means, with a portion of the means exposed for clarity.

The range of vertical movement is illustrated in FIG. 2, with sufficient clearance underneath platform 101 and end platform 20 to allow unobstructed movement of the transport container 110 when the platform 101 is raised to its full upper position. As shown in FIGS. 3 and 4, vertical movement of a platform 100 or 101 is accomplished by vertical movement means 30, which may comprise a number of counterweights 31 contained in counterweight housings 33 matched with lift motors 32 and lift cables 34 on pulleys 36. Each platform 100 or 101 is connected to the vertical members 201 of the support structure 200 by a number of sliding platform mounts 35. The counterweights are of sufficient weight to generally balance the weight of the platform 100 or 101, such that raising and lowering the platform 100 or 101 is accomplished by relatively low power lift motors 32.

Figure 5:
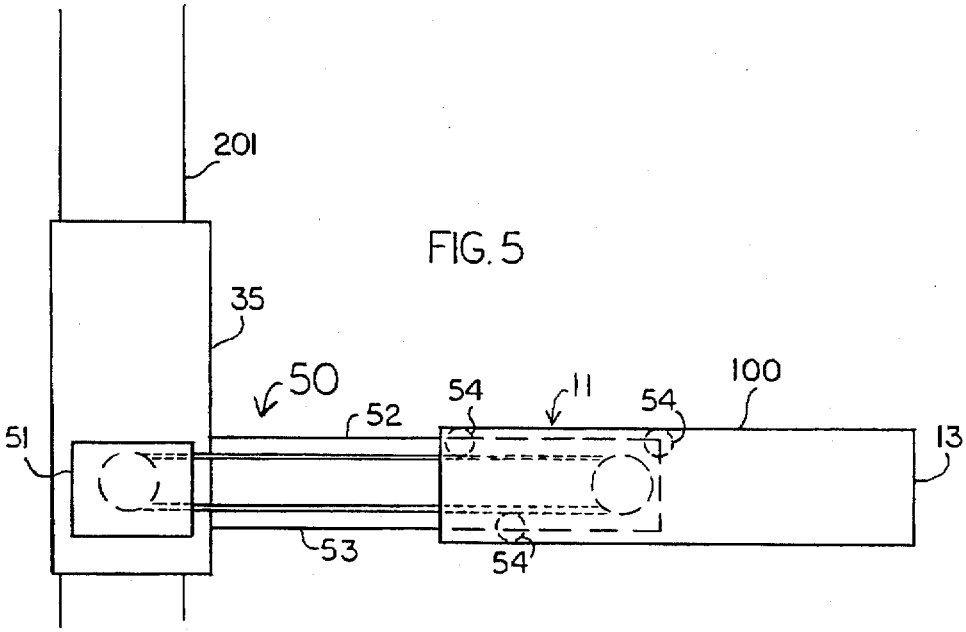
FIG. 5 is an end view of the platform showing it in the laterally extended position.

Horizontal or lateral movement of the platforms 100 or 101, or more precisely of the working surface 11, is shown in FIG. 5. In order to provide safe working conditions, the interior edge 13 of each work surface 11 should be positioned relatively close to the side 111 of the transport container 110, preferably such that the separation distance is only a matter of inches. This prevents the workers from slipping between the work surface 11 and the transport container 110 and also makes it less likely for a dropped tool or part to fall to the ground. Platform lateral movement means 50 move each work surface 11 laterally toward the center of the apparatus, thereby allowing for variance in the width of the transport containers 110. In the example of a standard transport trailer 110, lateral movement of each work surface 11 approximately 2 feet is desirable, thus providing a 4 foot positioning range between the two opposing work surfaces 11. Lateral movement means 50 may be of any known type, and for example may comprise one or more drive motors 51 connected to drive chains 53 which move the work surface 11 along runners 54 mounted on lateral support members 52. It is preferable that the vertical movement means 30 be inoperable unless the work surface 11 is in its fully withdrawn position. That is, controls 93 and 94 on operator control stations 16 will not move the platforms 100 or 101 unless the work surface 11 has been fully retracted into the out position.

Figure 8:
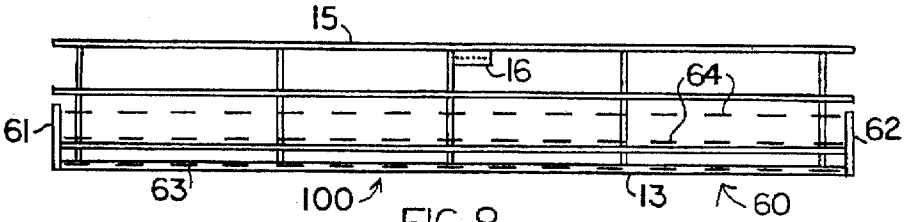
FIG. 8 is a longitudinal side view of a platform showing the IR beams.
Figure 9:
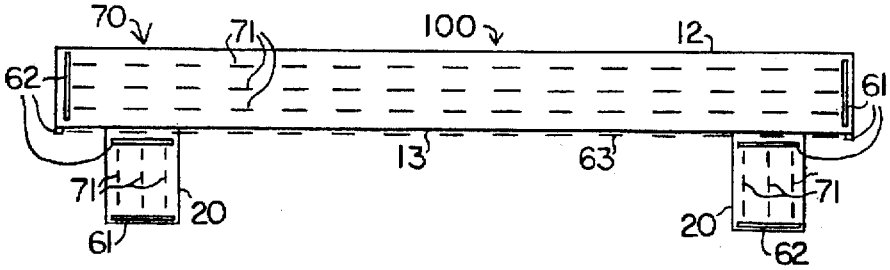
FIG. 9 is a bottom view of a platform showing the IR beams.

While it is possible for the vertical and lateral movement to be controlled visually by the operator, it is preferable that automatic positioning means 60 be incorporated into the invention to prevent damage to the apparatus or to the transport trailer by excessive movement. The lowest and highest vertical position of each platform 100 or 101 should be automatically controlled by stopping mechanisms, and the interior lateral positioning of the work surface 11 should also automatically controlled. Preferably a number of infrared (IR) beam transmitters 61 and IR receivers 62 are utilized for this task. For example, as shown in FIG. 8 and 9, the interior lateral positioning is controlled by an interior edge IR beam 63 which extends the length of the interior edge 12 of work surface 11 and automatically stops movement of the work surface 11 when the IR beam 63 is broken by any portion of the transport container 110 or by any other object, such as a hanging tool or even the operator's foot.

Additional IR beam transmitters 61 and receivers 62 are incorporated in automatic safety means 70 which stop movement of the platform 100 or 101 whenever a particular IR beam is interrupted. For example, a number of sub-platform IR beams 71 are preferably mounted beneath the work surface 11 and end platforms 20 of each platform 100 or 101 to stop the downward movement if an obstruction is encountered. Worker IR beams 64 at foot height and at knee height may also be positioned down the interior edge 12 of each work surface 11 to prevent vertical or lateral movement if an operator is too near the edge.

Figure 6:
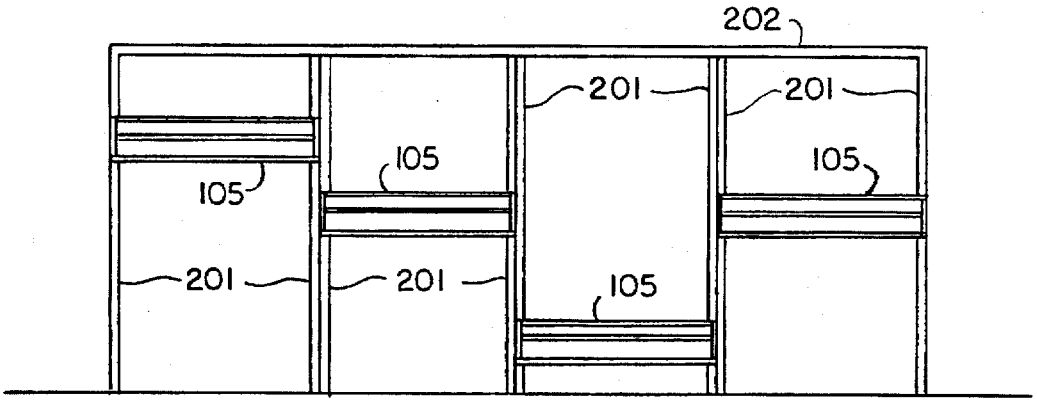
FIG. 6 is a side view of a platform showing a number of independent work surfaces.

Each platform 100 or 101 may comprise a single, unitary work surface 11 or may be separated into a plural number of segments 105 each having its own work surface 11, where each segment 105 may be independently operated and positioned at different vertical or lateral locations if desired as shown in FIG. 6. In this embodiment, each segment 105 will have a separate operator control station 16 and individual safety gates 17.

It is contemplated that those skilled in the art may be aware of equivalents and substitutions to the components set forth above. The full scope and definition of the invention therefore is to be as set forth in the following claims.

We claim:

1. A multiple lift platform apparatus comprising:

(A) a rigid, generally rectangular support structure having two longitudinal sides and at least one open lateral end;

(B) a pair of opposing, independently operable platforms, one said platform mounted on one said longitudinal side of said support structure, the other said platform mounted on the other said longitudinal side of said support structure, where said platforms are capable of movement in the vertical direction and movement toward each other in the lateral direction;

(C) movement means to move said platforms in the vertical direction and in the lateral direction;

(D) one or more end platforms mounted on each of said platforms, where each said end platform extends laterally from said platform and where each said end platform is longitudinally positionable along said platform.

2. The apparatus of claim 1, further comprising automatic positioning means to control movement of said platforms.

3. The apparatus of claim 2, where said automatic positioning means comprise one or more infrared beam transmitter means and one or more infrared beam receiving means.

4. The apparatus of claim 2, where said automatic positioning means are located along a longitudinal edge of each of said platforms.

5. The apparatus of claim 1, further comprising automatic safety means to control movement of said platforms.

6. The apparatus of claim 5, where said automatic safety means comprise one or more infrared beam transmitter means and one or more infrared beam receiver means.

7. The apparatus of claim 6, where said automatic safety means are located beneath each said platform and each said end platform.

8. The apparatus of claim 1, where each said platform is comprised of a number of independently operable segments, each segment adapted for movement in both the vertical and lateral direction.

9. The apparatus of claim 1, each said one or more end platforms further comprising at least one laterally extendible extension member.

10. A multiple lift platform apparatus for use in combination with transport containers, said apparatus comprising:

(A) a support structure having two longitudinal sides and at least one open lateral end;

(B) a first independently operable platform mounted on one said longitudinal side of said support structure, said first platform adapted to move both vertically and laterally;

(C) a second independently operable platform mounted on the other said longitudinal side of said support structure, said second platform adapted to move both vertically and laterally;

(D) a first pair of longitudinally positionable end platforms mounted on said first platform and a second pair of longitudinally positionable end platforms mounted on said second platform, said first and second pairs of end platforms extending laterally from said first and second platforms;

whereby said first and second platforms can be moved laterally toward each other such that said first pair of end platforms are adjacent said second pair of end platforms, thereby completely encircling a transport container.

11. The apparatus of claim 10, further comprising automatic positioning means to control movement of said first and second platforms.

12. The apparatus of claim 11, where said automatic positioning means comprise one or more infrared beam transmitter means and one or more infrared beam receiver means.

13. The apparatus of claim 10, further comprising automatic safety means to control movement of said first and second platforms.

14. The apparatus of claim 13, where said automatic positioning means comprise one or more infrared beam transmitter means and one or more infrared beam receiver means.

15. The apparatus of claim 10, where said first platform and said second platform are comprised of a number of independently operable segments, each segment being adapted to move both vertically and laterally.

16. The apparatus of claim 10, where said first platform and said second platform are longer than said transport container.

17. The apparatus of claim 10, each said first and said second pair of longitudinally positionable end platforms further comprising at least one laterally extendible extension member.

* * * * *